US005095865A

United States Patent [19]

Keister

[11] Patent Number: 5,095,865

[45] Date of Patent: Mar. 17, 1992

[54] REMOTELY CONTROLLED STARTER FOR MODEL TOY ENGINES

[76] Inventor: Harry W. Keister, P.O. Box 3285, Pearland, Tex. 77581

[21] Appl. No.: 503,212

[22] Filed: Apr. 2, 1990

[51] Int. Cl.[5] ..... F02N 11/00; F02N 11/08

[52] U.S. Cl. ..... 123/179.5; 123/DIG. 3; 123/179.25; 123/179.26; 74/9; 74/7 E; 290/38 C

[58] Field of Search ..... 123/179 R, 179 A, 179 B, 123/179 BG, 179 M, 179 SE, DIG. 3; 290/38 C; 74/9, 7 E

[56] References Cited

U.S. PATENT DOCUMENTS

| | | | |
|---|---|---|---|
| 2,219,672 | 10/1940 | Ysskin | 74/9 |
| 2,475,750 | 7/1949 | McCormick | 318/447 |
| 2,865,358 | 12/1958 | Musgrave | 123/179 SE |
| 3,248,555 | 4/1966 | Fried | 123/179 B |
| 3,939,369 | 2/1976 | Sullivan | 310/89 |
| 4,183,341 | 1/1980 | Eastman | 123/179 |
| 4,335,318 | 6/1982 | Mabuchi et al. | 290/31 |
| 4,653,444 | 3/1987 | Brockbank et al. | 123/179 AS |

OTHER PUBLICATIONS

Jul. 1990 issue R. C. Modeler pp. 238, 239, 260, 261 title "Hobby Lobby (FEMA) On-Board Engine Starter", author Jim Feldmann.

*Primary Examiner*—Andrew M. Dolinar

[57] ABSTRACT

A system for remotely starting model toy internal combustion engines, used for propulsion of the model toy, such as an airplane, helicopter, boat, automobile, or other similar vehicles. The starter mechanism being contained in a single case, coupled to a single gear attached to the model engines crankshaft. The starter case being sufficiently small so as to allow it to be mounted directly to the model toys internal combustion engine. An electrical starter motor attached to the starter mechanism case, for cranking the engine, operating from the internal batteries on board the model toy. A remotely controlled servo starting circuit that energizes the engines ignitor plug, allowing sufficient preheat time, and activates the starter motor, from signals provided by the radio receiver on board the model toy vehicle.

5 Claims, 3 Drawing Sheets

FIG.3A
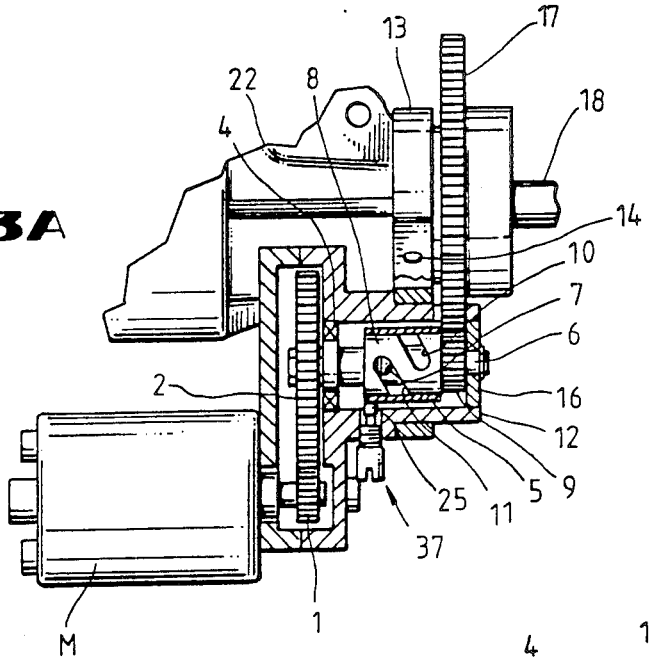
FIG.3B
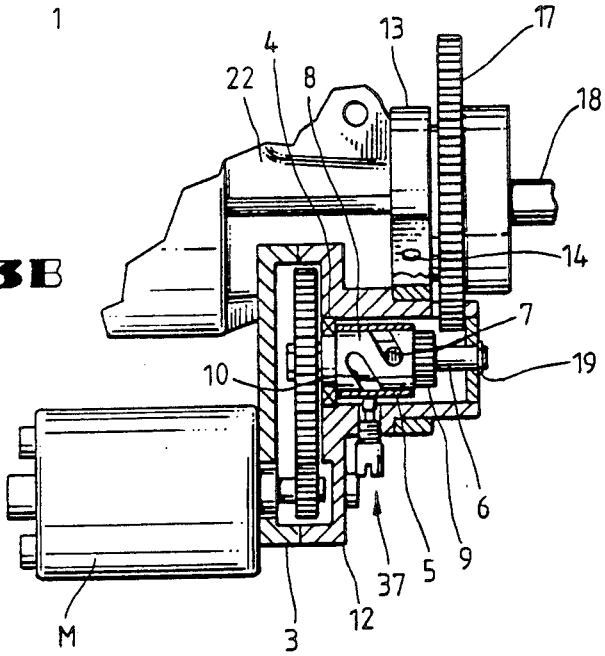
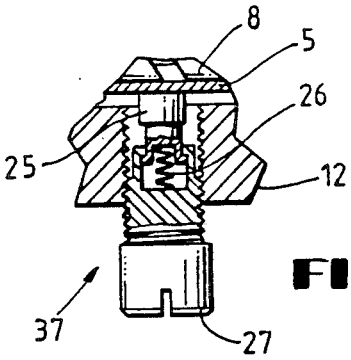
FIG.4
FIG.6
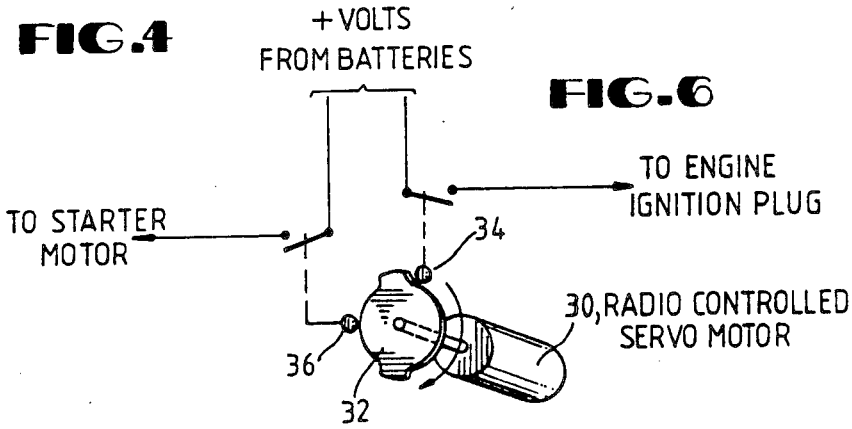

REMOTELY CONTROLLED STARTER FOR MODEL TOY ENGINES

BACKGROUND—FIELD OF THE INVENTION

This invention relates to systems for starting model toy engines of the internal combustion type, by remotely controlled radio signals.

BACKGROUND—DESCRIPTION OF PRIOR ART

Heretofore, the attachment of a starter system to a model toy, such as an airplane, helicopter, boat, automobile, and other similar vehicles using an internal combustion engine for propulsion, and controlled by remotely transmitted radio signals required numerous complex modificatons to the model toys framework. In and around the mounting structure of the internal combustion engine. Gears, shafts, bearings, couplings, clutches and the like were placed internal to the model toys body and positioned such as to align the starter drive mechanism so as to produce satisfactory operation of the starter apparatus. Moreover, on the crankshaft of the internal combustion engine it was required that an extenstion part be added to the distal end of the shaft to accomodate the placement of a clutch, bearings, and the like. It is suggested that additional modifications could be made to the engine crankcase allowing the crankshaft to be extended to the rear of the engine and coupled to the starter appartus in a like manner.

Generally, the installation of a remotely controlled starter apparatus to a model toy having an internal combustion engine for propulstion is a complicated and time consuming task.

I am aware of an "on board" remotely controlled starter described in the 1989/1990 catalog publication of the Hobby Lobby Int. Inc. and that Eastman discloses a remotely controlled starter system in U.S. Pat. No. 4,183,341, further Mabuchi discloses an engine driven model toy with an "on board" starter in U.S. Pat. No. 4,335,318.

As distinguished from these disclosures, my invention provides a starter apparatus that requires no modifications to the model toys framework, crankcase, or crankshaft of the model toy engine, but is simply positioned adjacent to the model toy engine and secured in place by means of an attachable clamping type part affixed to the engine crankcase. Further, the starter apparatus is coupled to the crankshaft of the engine by a single gear wheel attached to the existing model engine crankshaft without need of modification.

The remotely controlled servo starter circuit is relatively simple and readily placed in the body of the model toy.

SUMMARY OF THE INVENTION

Accordingly, several objects and advantages of the invention are:

It is an object of my invention to provide a lightweight high-torque starter system operating off the internal batteries of the model toy and controlled by remotely transmitted radio signals and can be readily installed in the model toy.

It is another object of my invention to provide a starter apparatus having a transmission mechanism contained in a single case.

It is still another object of my invention to provide a single gear wheel removably attached to the engine crankshaft without modification to the crankshaft.

It is a further object of my invention to provide a removably attached clamping type part that when attached to the single case containing the transmision mechanism causes the single gear wheel mounted on the engine crankshaft to be placed in exact alignment with the transmission mechanism contained in the single case.

It is still a further object of my invention to provide a fractional horsepower motor, attached directly to the transmission mechanisms case, which operates off the internal batteries of the model toy.

Also, a further object of my invention is to provide a remotely controlled servo.starting circuit operating off the internal batteries of the model toy which provides electrical circuits to "preheat" the model engine ignitor plug and power the starter motor.

The above objects and novel features of my invention will become apparent from the consideration of the drawings and ensuing description.

BRIEF DESCRIPTION OF THE DRAWINGS

FIG. 3A is a partial cross sectional view of the starter transmission mechanism showing the apparatus in the engaged or "crank" postion.

FIG. 3B is a partial cross sectional view of the starter transmission mechanism showing the apparatus in the disengaged position.

FIG. 4 is a partial cross sectional view of the adjustable brake assembly.

FIG. 6 is a diagram of the remotely controlled servo starting circuit. (The radio transmitter and receiver are not shown).

DETAILED DESCRIPTION OF THE DRAWINGS

Figure 2:
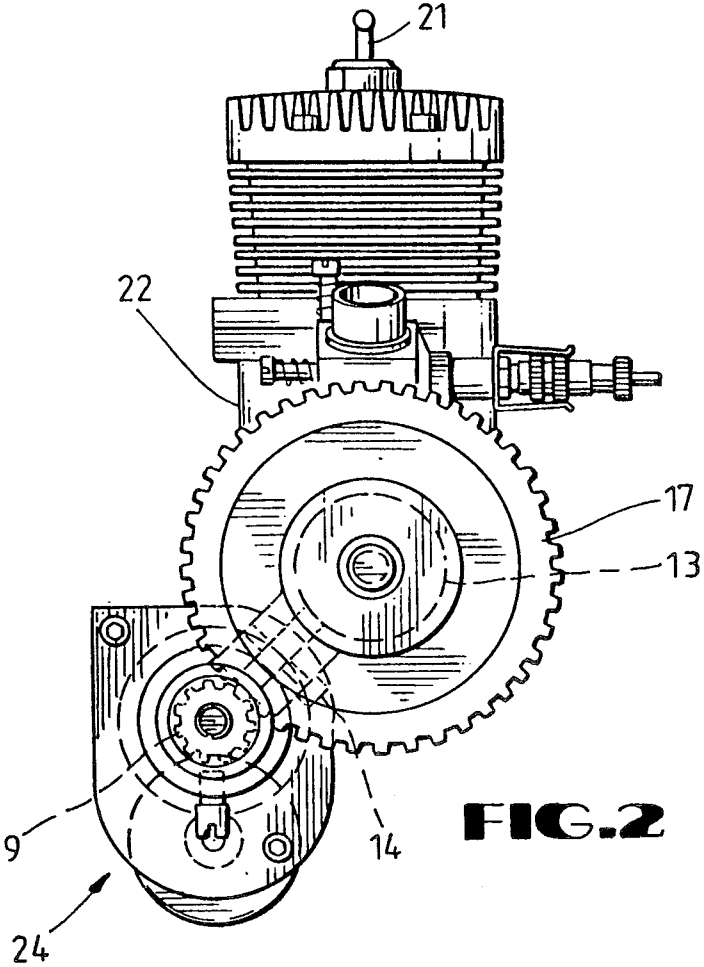
FIG. 2 is a front elevation of the starter transmission mechanism as attached to the models internal combustion engine.
Figure 1:
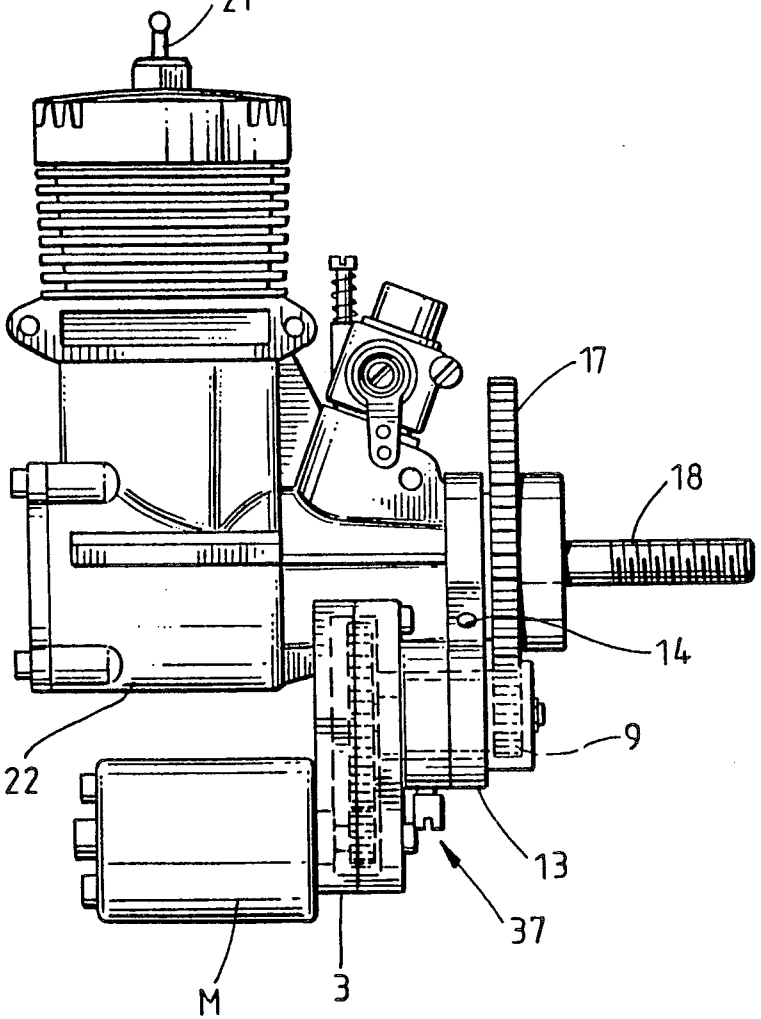
FIG. 1 is a side elevation of the starter transmission mechanism, as attached to the models internal combustion engine.
Figure 5:
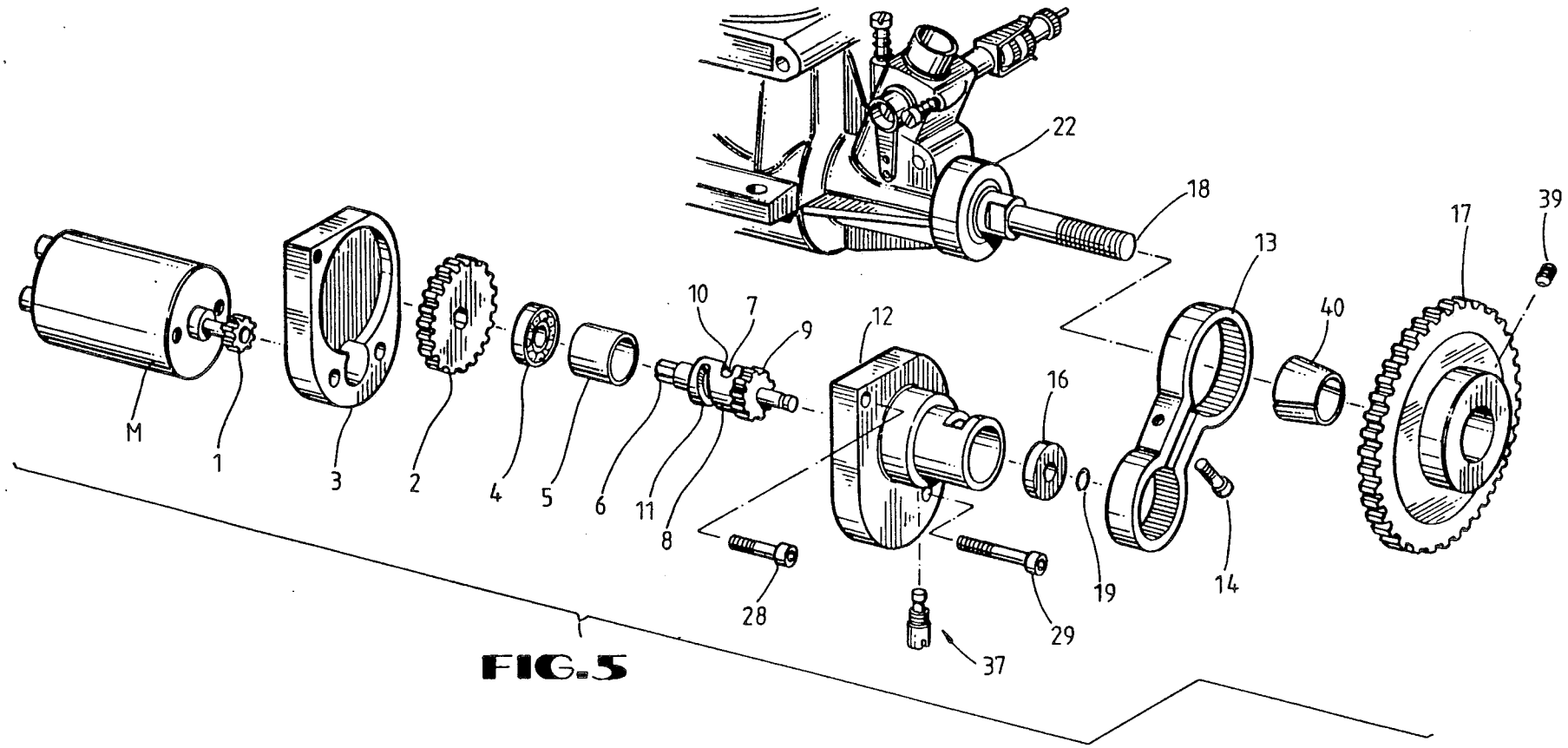
FIG. 5 is an exploded view of the apparatus.

Referring now to the drawings and first to FIG. 1 and FIG. 2, the starter case 24 constructed, as illustrated, is attached to the engine 22 by means of the removably attached ring clamp 13 and secured by retained screw 14 this can be more clearly seen in the exploded view shown in FIG. 5, but it must be borne in mind that the removable ring clamp 13 may take any other suitable form without departing from the scope hereof. Again referring to FIG. 1 and FIG. 2 particularly to this front elevation shown in FIG. 2 it will be seen that the second driven gear 17 attached to the engine crankshaft 18 is caused to be in alignment with the second pinion gear 9 by means of ring clamp 13. The motor M is attached the rear starter case 3 by screws (not shown). The ignitor plug is shown as 21 the model engine as 22.

Referring now to FIG. 3A, the motor M carries the first pinion gear 1 permanently in mesh with first driven gear 2 attached to the drive shaft 6 and journalled by the rear bearing 4 and the front bearing 16 the drive shaft 6 carries the drive pin 7 perpendicular to it's axis of rotation, and so positioned to intercept to helical slots 10 and 11 that are machined in the helix sleeve 8. The helix sleeve 8 carries the second pinion gear 9 and is concentrically disposed in the brake drum 5. The brake drum 5 is tightly journalled about the helix sleeve 8 such as to contain the drive pin 7 which is carried by the drive shaft 6. It should be understood that the helical slots 10 and 11 are machined in the opposite faces of the helix sleeve 8 ,producing a helical path in which the drive pin 7 is disposed. The transmission mechanism is shown to be in the engaged position or "crank" position.

Referring now to FIG. 3B, the transmission mechanism is shown in the disengaged position, after engine start has been effected (Both FIG. 3A and 3B illustrate the drive pin 7 in a fixed angular plane for purposes of clarity.) The helix sleeve 8 and the brake drum 5 are shown in the positions that they would normally be when in the fully engaged (FIG. 3A) and full disengaged positions (FIG. 3B).

Referring now to FIG. 4, the illustration of the adjustable brake assembly 37 shows the brake disc 25 tension spring 26 adjustment screw 27 the brake drum 5 helix sleeve 8 and front case 12.

Referring now to FIG. 5, the exploded view of the apparatus shows the motor M carrying the first pinion gear 1 attached to the rear case 3 (screws not shown) the first pinion gear 1 is in permanent mesh with the first driven gear 2 attached to the drive shaft 6 journalled by the rear bearing 4 and the front bearing 16 the rear bearing 4 and the front bearing 16 are tightly journalled in the bore of the front case 12 the drive shaft 6 is held in place by retaining clip 19 the helix sleeve 8 carries the second pinion gear 9 and is concentrically positioned on the drive shaft 6 and its helically machined slots 10 & 11 are intercepted by the drive pin 7 perpendicular to the drive shaft 6. The adjustable brake assembly shown as 37 the retaining screws 28 & 29 attach the rear case 3 to the front case 12 so as to align the transmission mechanism. A radial slot is evidenced in the front case 12 allowing the second pinion gear 9 to engage with the second driven gear 17. The ring clamp 13 is secured to the engine crankcase 22 and the front case 12 by means of the clamping screw 14. The tapered bushing 40 is placed in the bore of the second driven gear 17 mounted on the engine crankshaft 18 secured by retaining screw 39.

Referring now to FIG. 6 the remotely controlled servo 30 carries servo cam 32 and illustrated to show the rotation of the cam 32 operating cam switches 34 and 36 (The radio transmitter and receiver are not shown). The batteries are internal to the model toys body.

OPERATION OF THE INVENTION

As remotely transmitted radio signals cause the model toys "on board" remotely controlled servo 30 to rotate (as illustrated in FIG. 6) the cam switch 34 closes, energizing the ignitor plug 21 of the engine 22. As the cam continues to rotate the cam switch 34 is caused to open. (The "pre-heat" time of ignitor plug 21 is only momentary, as this is sufficient to initiate a start of the engine.) The servo cam 32 (in its continuing rotation) now closes cam switch 36 energizing the starter motor M.

It is to be understood that the adjustable brake assembly 37 has been previously adjusted to produce the following action on the transmission mechanism. The brake drum 5 which is tightly journalled around the helix sleeve 8 is restricted from freely rotating about the drive shaft 6 by the force appled to the brake drum 5 from the brake disc 25 and tension spring 26 thus causing a snubbing action thereby restricting the free rotational movement of the helix sleeve 8. However, this snubbing action is so set by the adjustment screw 27 so as not to restrict the longitudal movement of the helix sleeve 8 and the brake drum 5 along the axis of rotation of the drive shaft The drive pin 7, carried by the drive shaft 6 intercepts the helically machined slots 10 and 11 in the helix sleeve 8 with sufficent torque produced by the drive motor through gears 1 and 2 to cause the helix sleeve 8 carrying the second pinion gear 9 to be moved,along with the brake drum 5,to the point whereby the drive pin 7 has reached the ends of the helical slots 10 and 11. In this position (as illustrated in FIG. 3A) the second pinion gear 9 is in full engagement with the second driven gear 17.

The torque exerted on the drive pin is now fully applied to the helix sleeve 8 causing it rotate with the drive shaft 6 and to overcome the snubbing action of the brake disc 25 on the brake drum 5, thereby "cranking" the engine.

As the model engine 22 has now started,the operator(by remote control)disables the servo 30 thereby the drive motor is disconnected from the internal battery power of the model toy. Both cam switches 34 and 36 are now in an "off" position, or a ready to re-start position.

Meanwhile the engine 22 has developed sufficent Reveloutions per minute to produce a torque value applied to the second driven gear 17 to cause the second pinion gear 9, attached to the helix sleeve to be moved to the disengaged position(that is illustrated in FIG. 3B).

It is to be understood that second driven gear 17 is now operating as a driving gear powered by the engine 22 therefore the description of operation of the mechanism is the same as described above, in the opposite direction.

Although the description above contains many specificities the broad scope of the invention is to provide the preferred embodiments of the starter transmission mechanism be contained in a single case readily attached to a model toy engine without need of complex modifications.

The scope is determined by the claims which follow.

I claim:

1. A system for starting a model toy internal combustion engine by means of remotely transmitted radio signals for use in model toy airplanes, helicopters, boats, automobiles and similar vehicles, comprising:

(a) a case containing a starter transmission mechanism, said case including means for direct mounting of an electric starting motor (b) a mounting part for removably attaching said case to the body of said engine; and (c) a driven gear attached to the engine crankshaft, said starter transmission mechanism including a pinion gear movable into direct driving engagement with said driven gear.

2. A system for starting a model toy internal combustion engine according to claim 1, wherein said mounting part is a clamp adjustably mounted to said case and the engine body so as to precisely align said driven gear and said pinion gear.

3. A system for starting a model toy internal combustion engine according to claim 1, further comprising:

a remotely controlled servo starting circuit including a servo device, a cam actuated by the servo device and switches operated by the cam connected for energizing the electric starting motor and an ignitor plug.

4. A system for starting a model toy internal combustion engine according to claim 3, wherein said cam and switches are arranged to sequentially energize said ignitor plug and said electric starting motor.

5. In a system for starting a model toy internal combustion engine by means of remotely transmitted radio signals for use in model toy airplanes, helicopters, boats, automobiles and similar vehicles, a mechanism for coupling an electric starting motor to a driven gear attached to the engine crankshaft comprising:

(a) a helix sleeve carrying a pinion gear moveable into engagement with said driven gear;

(b) a shaft rotatable by said electric starting motor and carrying a drive pin operatively coupled to said helix sleeve;

(c) a brake drum tightly journalled about said helix sleeve; and (d) adjustable brake means contacting said brake drum for restraining rotational movement of said helix sleeve so as to engage the pinion gear when said shaft is rotated.

* * * * *